US010801123B2

(12) United States Patent
Ding et al.

(10) Patent No.: US 10,801,123 B2
(45) Date of Patent: Oct. 13, 2020

(54) METHOD OF SEALING AN ANODIZED METAL ARTICLE

(71) Applicant: UNITED TECHNOLOGIES CORPORATION, Farmington, CT (US)

(72) Inventors: Zhongfen Ding, South Windsor, CT (US); Robert R. Hebert, Storrs, CT (US); Weilong Zhang, Glastonbury, CT (US); Bart Antonie van Hassel, Weatogue, CT (US); Mark R. Jaworowski, Glastonbury, CT (US); Michael A. Kryzman, West Hartford, CT (US); Blair A. Smith, South Windsor, CT (US); Georgios S. Zafiris, Glastonbury, CT (US); Promila Bhaatia, Farmington, CT (US); Mark A. Brege, Rockford, IL (US); Shaahin Amini, Riverside, CA (US); Vijay V. Pujar, San Diego, CA (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 341 days.

(21) Appl. No.: 15/469,663

(22) Filed: Mar. 27, 2017

(65) Prior Publication Data

US 2018/0274121 A1 Sep. 27, 2018

(51) Int. Cl.
*C25D 11/26* (2006.01)
*C25D 11/30* (2006.01)
(Continued)

(52) U.S. Cl.
CPC ..... *C25D 11/30* (2013.01); *C25D 11/20* (2013.01); *C25D 11/26* (2013.01); *C25D 11/08* (2013.01); *C25D 11/10* (2013.01)

(58) Field of Classification Search
None
See application file for complete search history.

(56) References Cited

U.S. PATENT DOCUMENTS 3,962,061 A 6/1976 Nikaido et al.
4,225,398 A 9/1980 Hasegawa et al.
(Continued)

FOREIGN PATENT DOCUMENTS

GB 2539965 A 1/2017
JP S54116349 A 9/1979

OTHER PUBLICATIONS

Lerner, I., et al., "An Electrochemically sealed Al2O3 Passivation Layer for Aluminum Alloys", J. Electrochem. Soc., Sep. 1982, p. 1865-1868. (Year: 1982).*

*Primary Examiner* — Stefanie S Wittenberg
(74) *Attorney, Agent, or Firm* — Carlson, Gaskey & Olds, P.C.

(57) ABSTRACT

A method of coating a metal article is disclosed that includes immersing a metal article having an exterior anodized layer in a bath containing a chemically active corrosion inhibitor, and applying a voltage to the article during the immersing, the voltage driving the chemically active corrosion inhibitor from the bath into the exterior anodized layer. An article is also disclosed that has a substrate comprising a metal, and a porous anodized layer formed on an exterior surface of the substrate that is infiltrated with a chemically active corrosion inhibitor, the anodized layer having an inward-facing region and an outward-facing region, the anodized layer having a greater concentration of chemically active corrosion inhibitors in the inward-facing region than in the outward-facing region.

17 Claims, 3 Drawing Sheets

(51) Int. Cl.

| | |
|---|---|
| ***C25D 11/20*** | (2006.01) |
| *C25D 11/10* | (2006.01) |
| *C25D 11/08* | (2006.01) |

(56) References Cited

U.S. PATENT DOCUMENTS

| | | | | | |
|---|---|---|---|---|---|
| 4,518,467 | A | | 5/1985 | Mason et al. | |
| 4,913,968 | A | | 4/1990 | Pocius | |
| 4,970,116 | A | * | 11/1990 | Kimura | B41N 3/034 428/332 |
| 5,582,654 | A | * | 12/1996 | Mansfeld | C23C 22/68 148/273 |
| 5,891,269 | A | | 4/1999 | Koerner et al. | |
| 5,925,228 | A | | 7/1999 | Panitz et al. | |
| 6,228,241 | B1 | | 5/2001 | Alwitt et al. | |
| 9,260,792 | B2 | | 2/2016 | Cabot et al. | |
| 2015/0090598 | A1 | * | 4/2015 | Tatebe | C25D 11/045 205/50 |
| 2016/0273123 | A1 | | 9/2016 | Yu et al. | |
| 2016/0312374 | A1 | | 10/2016 | Duffy et al. | |
| 2016/0319452 | A1 | | 11/2016 | Eidschun et al. | |

* cited by examiner

METHOD OF SEALING AN ANODIZED METAL ARTICLE

BACKGROUND

The present disclosure relates to sealing an anodized metal article.

Components made from metallic alloys, such as aluminum alloys, achieve higher strengths through inclusion of alloying elements. However, the presence of these alloying elements tends to make the alloy vulnerable to corrosion. Anodized coatings are used to protect aluminum alloys from corrosion, to enhance wear resistance, and to provide a layer to promote good adhesive bond strength.

Anodized coatings are porous, and it is known to seal an anodized coating by introducing a sealant into its pores to further enhance its corrosion resistance. Hexavalent chromium was a common sealant, but it has become recognized as carcinogenic and is therefore undesirable for use as a sealant.

SUMMARY

One example embodiment of a method of coating a metal article includes immersing a metal article having an exterior anodized layer in a bath containing a chemically active corrosion inhibitor; and applying a voltage to the article during the immersing, the voltage driving the chemically active corrosion inhibitor from the bath into the exterior anodized layer.

In another example embodiment of the above described method, after the immersing and applying steps are complete, a concentration of the chemically active corrosion inhibitor is greater in an inward-facing region of the anodized layer than in an outward-facing region of the anodized layer.

In another example embodiment of any of the above described methods, the chemically active corrosion inhibitor includes anions, and the voltage is a positive bias on the article.

In another example embodiment of any of the above described methods, the chemically active corrosion inhibitor includes cations, and the voltage is a negative bias on the article.

In another example embodiment of any of the above described methods, the chemically active corrosion inhibitor in the bath includes both anions and cations, and said applying a voltage to the article includes alternating between application of a positive voltage to drive the anions into the exterior anodized layer and a negative voltage to drive the cations into the exterior anodized layer during the immersing.

In another example embodiment of any of the above described methods, the positive voltage and negative voltage are part of an alternating current (AC) voltage waveform.

In another example embodiment of any of the above described methods, a duration of the applying step is approximately 2-5 minutes, and the voltage is between approximately 3 volts-60 volts.

In another example embodiment of any of the above described methods, the voltage is between approximately 10 volts-15 volts.

In another example embodiment of any of the above described methods, said immersing and applying are performed for a first bath containing a first type of chemically active corrosion inhibitor, and are separately performed for a second bath containing a second type of chemically active corrosion inhibitor, such that both types of chemically active corrosion inhibitors are driven into the exterior anodized layer.

In another example embodiment of any of the above described methods, a duration of the applying step in each bath is approximately the same, and the voltages used during each applying step are approximately the same.

In another example embodiment of any of the above described methods, one of the first and second type of chemically active corrosion inhibitor are anions, and the other of the first and second type of chemically active corrosion inhibitor are cations.

In another example embodiment of any of the above described methods, the chemically active corrosion inhibitor is selected from the group comprising at least one of permanganate ions, vanadate ions, tungstate ions, molybdate ions, $ZrF_6^{2-}$, $CrF_6^{3-}$, silicate ions, citrate ions, phosphate ions, nitrate ions, or a combination thereof.

In another example embodiment of any of the above described methods, the chemically active corrosion inhibitor includes a nanoparticle pigment, and the bath includes a colloidal solution in which the nanoparticle pigment is suspended.

In another example embodiment of any of the above described methods, the nanoparticle pigment is selected from the group comprising at least one of $Ce_2(MoO_4)_3$, $ZnMoO_4$, $CaMoO_4$, cerium citrate, $MgSiO_3$, $ZnSiO_3$, $CaSiO_3$, $Cr(OH)_3$, $ZrO_2$, $TiO_2$, $NbO_x$, $ZnO_2$, $CoO_x$, phosphates, silicates, nitrates, aggregates of colloidal nanoparticles formed from ions of $PO_4^{3-}$, $SiO_3^{2-}$, $B_2O_4^{2-}$, $Ce^{3+}$, $Y^{3+}$, $La^{3+}$, $Pr^{3+}/Pr^{2+}$, $VO_4^{3-}$, $MoO_4^{2-}$, or $WO_4^{2-}$, or a combination thereof.

One example of an article includes a substrate comprising a metal, and a porous anodized layer formed on an exterior surface of the substrate that is infiltrated with a chemically active corrosion inhibitor. The anodized layer has an inward-facing region and an outward-facing region, and has a greater concentration of chemically active corrosion inhibitors in the inward-facing region than in the outward-facing region.

In another example of the above described article, the porous anodized layer is infiltrated with a cation type of chemically active corrosion inhibitor, an anion type of chemically active corrosion inhibitor, or a combination thereof.

In another example of any of the above described articles, the chemically active corrosion inhibitor is selected from the group consisting of permanganate ions, vanadate ions, tungstate ions, molybdate ions, $ZrF_6^{2-}$, $CrF_6^{3-}$, silicate ions, citrate ions, phosphate ions, nitrate ions, and a combination thereof.

In another example of any of the above described articles, the chemically active corrosion inhibitor infiltrates to a depth of at least 50% of the porous anodized layer.

In another example of any of the above described articles, the at least one type of chemically active corrosion inhibitor includes nanoparticle pigments.

In another example of any of the above described articles, the chemically active corrosion inhibitor is selected from the group comprising $Ce_2(MoO_4)_3$, $ZnMoO_4$, $CaMoO_4$, cerium citrate, $MgSiO_3$, $ZnSiO_3$, $CaSiO_3$, $Cr(OH)_3$, $ZrO_2$, $TiO_2$, $NbO_x$, $ZnO_2$, $CoO_x$; aggregates of colloidal nanoparticles formed from ions of $Ce^{3+}$, $Y^{3+}$, $La^{3+}$, $Pr^{3+}/Pr^{2+}$, $VO_3^{-}$, $MoO_4^{2-}$, $WO_4^{2-}$, $PO_4^{3-}$, $SiO_3^{-}$, or $B_2O_4^{2-}$; or a combination thereof.

In another example of any of the above described articles, the metal comprises of at least one of aluminum, magnesium, titanium or an alloy of aluminum, magnesium, or titanium.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

One method of sealing an anodized layer of an aluminum article involves soaking the anodized article in a bath containing a corrosion inhibitor, which requires long times for the inhibitor to infiltrate even a short distance into the anodized layer. As described below, a disclosed method uses an applied voltage to drive a chemically active corrosion inhibitor into an anodized layer, which may reduce treatment time, achieve a greater concentration of the corrosion inhibitors in the anodized layer, and drive the corrosion inhibitors further into the anodized layer.

Figure 1:
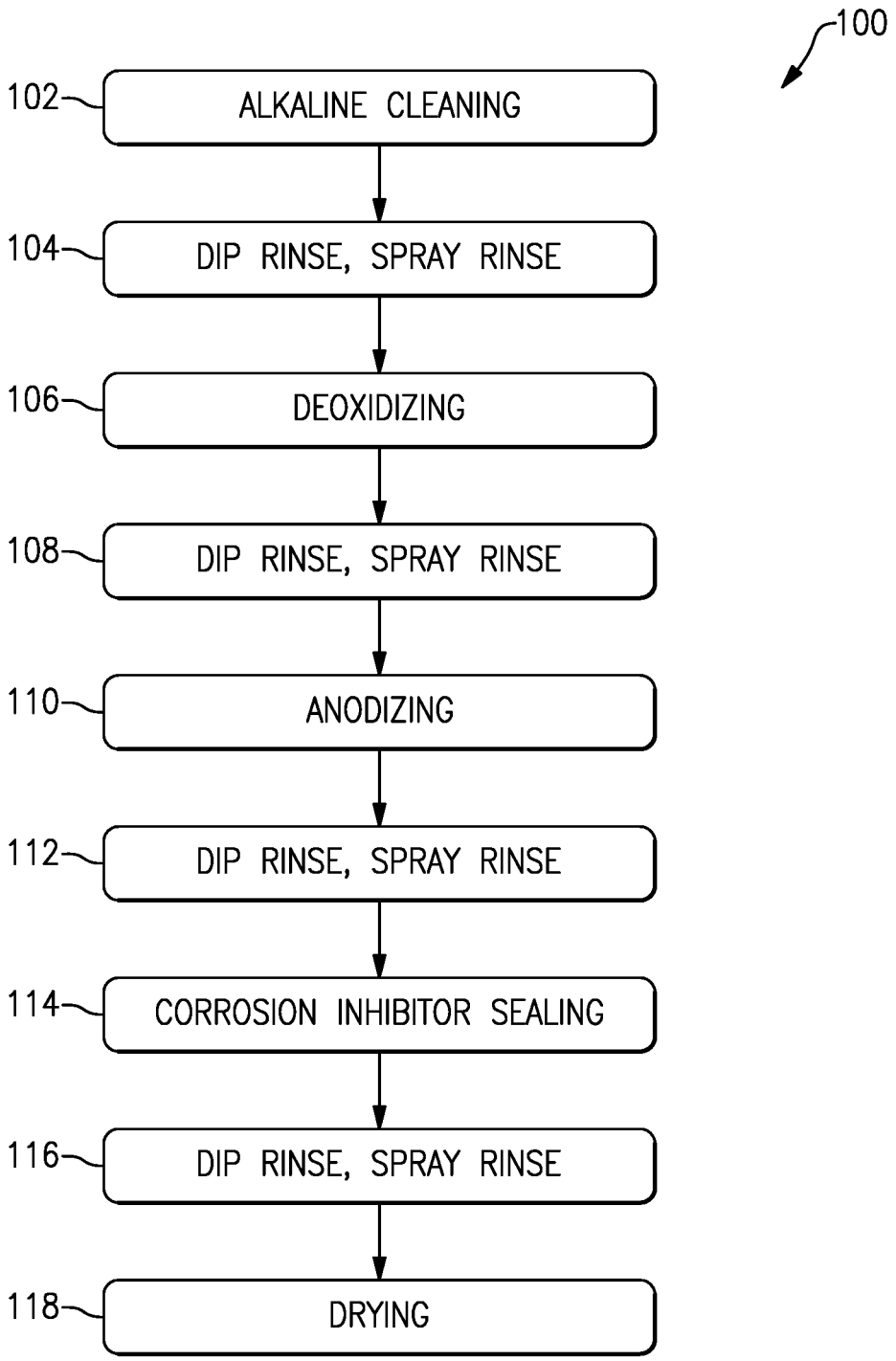
FIG. 1 schematically illustrates an example method of coating an article.

FIG. 1 schematically illustrates a method 100 of coating a metal article, such as one composed of an aluminum alloy (some non-limiting examples include 2000 series, 3000 series, and 7000 series aluminum alloys), a titanium alloy, or a magnesium alloy, for example. The article is first cleaned through an alkaline cleaning process (step 102), and is rinsed using a dip rinse and/or spray rinse (step 104). The article is then deoxidized (step 106), and dip rinsed and/or spray rinsed (step 108). The article is then anodized (step 110), resulting in an anodized outer coating on the article, and the anodized article is dip rinsed and/or spray rinsed (step 112). The anodizing of step 110 may include chromic acid anodizing (CAA), boric sulfuric acid anodizing (BSAA), sulfuric acid anodizing (SAA), thin film sulfuric acid anodizing (TFSAA), or tartaric sulphuric acid anodizing (TSA), for example, but is not limited to these anodizations. The anodized article is sealed with a corrosion inhibitor (step 114), is optionally dip rinsed and/or spray rinsed (step 116), and is dried (step 118). Although step 114 may be part of the sequential, continuous method 100 shown in FIG. 1, it is to be understood that the steps other than 114 may be conventional and that, in some examples, step 114 may be performed separate in time or location from one or more of the other steps. Also, although alkaline cleaning is mentioned in step 102, it is understood that other types of cleaning could be used if desired (e.g., acidic or neutral cleaning solutions could be used, including solvent degreasing).

Figure 2:
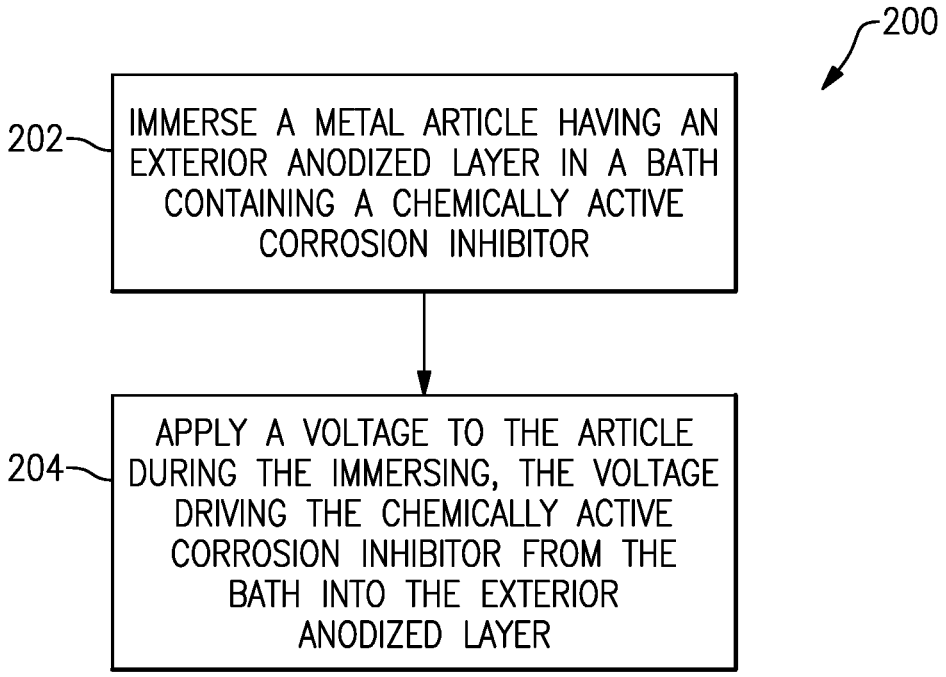
FIG. 2 schematically illustrates an example corrosion inhibitor sealing method.

FIG. 2 schematically illustrates an example corrosion inhibitor sealing method 200 that may be used for step 114 of FIG. 1. A metal article having an exterior anodized layer is immersed in a bath containing a chemically active corrosion inhibitor (step 202). A voltage is applied to the article during the immersing of step 202, thereby driving the chemically active corrosion inhibitor (e.g., ions or colloidal nanoparticles) from the bath into the exterior anodized layer (step 204). As used herein, a "chemically active" corrosion inhibitor is one that retains its ability to chemically react to prevent corrosion after it has infiltrated an anodized layer. For instance, a chemically active corrosion inhibitor may prevent the reduction of oxygen or oxygen species. As another example, a chemically active corrosion inhibitor may be reactive with exposed substrate aluminum surface to form a precipitate sealing the exposed surface. In some examples, the corrosion inhibitor also acts as an adhesion promotor by promoting adhesion to a topcoat, for example.

Use of the method 200 provides a greater density of corrosion inhibitors in the anodized layer, and also drives the corrosion inhibitors deeper into the anodized layer than the soaking-only corrosion inhibitor sealing method described above. In some examples, when the corrosion inhibitors are driven further into the anodized layer, the anodized layer provides better adhesion for paint, primers, and/or other top coats because the corrosion inhibitors are not concentrated at an outer surface of the anodized layer to weaken adhesion. Moreover, use of the method 200 provides a significant reduction in time over the soaking-only corrosion inhibitor sealing method. Instead of soaking the anodized article for 15 to 20 minutes, the technique described in FIG. 2 can be completed on the order of 2 to 5 minutes in some examples.

Although the method 200 may be part of the sequential, continuous method 100 shown in FIG. 1, it is understood that in some examples the method 200 may be performed separate in time or location from one or more of the other steps.

Figure 3:
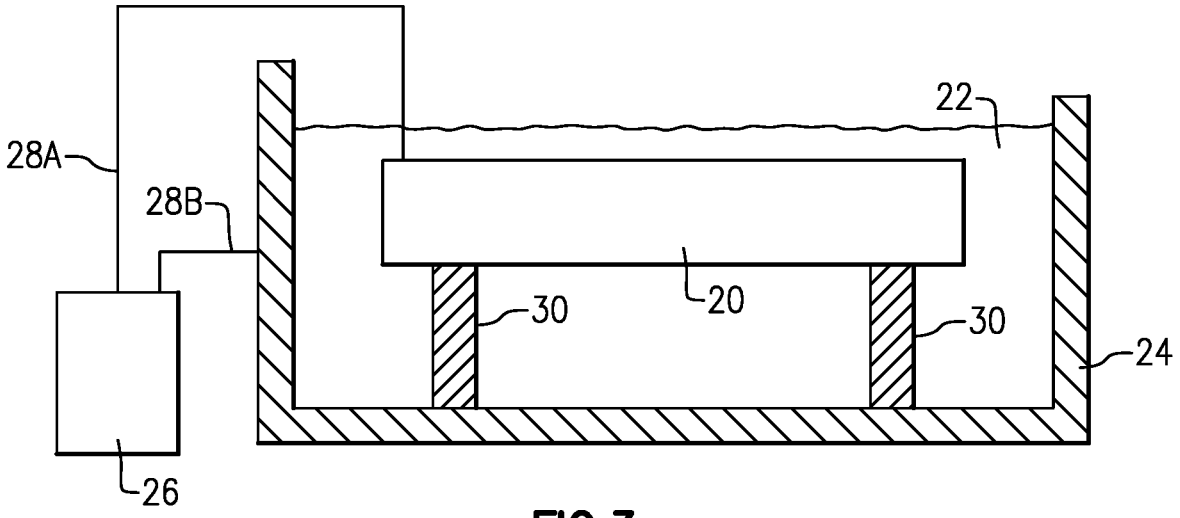
FIG. 3 schematically illustrates an example apparatus for performing the method of FIG. 2.

FIG. 3 schematically illustrates an example of an apparatus for performing the method 200 of FIG. 2. An anodized metal article 20 is immersed in a bath 22 containing at least one chemically active corrosion inhibitor. In one example, the anodized article 20 is a part of a vehicle, such as a gas turbine engine (e.g., a stator, housing, or case of a gas turbine engine). Of course, other articles 20 could be used. The bath 22 is contained within a basin 24. A power source 26, such as an electrical outlet, a rectifier, or a battery, is connected to the article 20 through line 28A, and is connected to the electrically conductive basin 24 through line 28B. These connections cause the article 20 and basin 24 to act as electrodes when connected to the power source 26. A counter electrode made of stainless steel, Al, Ti, graphite, or other appropriate conductors shall be used if the basin 24 is not made of an electrically conductive material, or for applications which require the use of internal counter electrodes whereby the electric current distribution from a conductive basin would not permit transfer of the proper current density to internal cavities, etc. In the example of FIG. 3, the anodized metal article 20 rests on non-conductive supports 30 within the bath 22. Of course, this is only an example and it is understood that other arrangements for suspending the article 20 within the bath 22 could be used (e.g., connecting the article 20 to a rack suspended in the bath 22).

Figure 4:
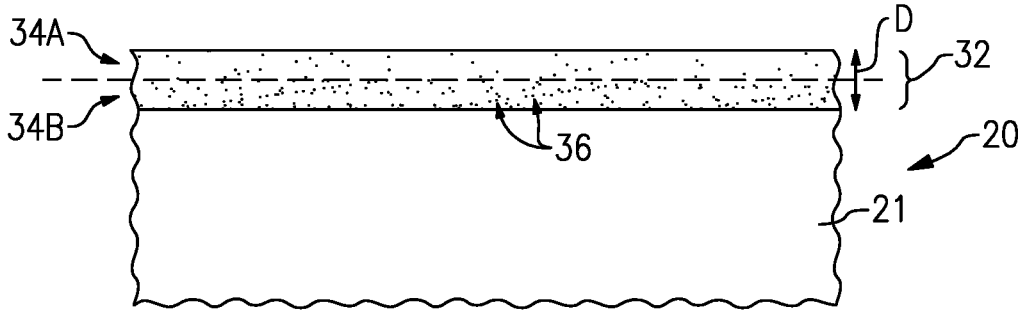
FIG. 4 schematically illustrates an example anodized layer sealed according to the method of FIG. 2.

While the article 20 is immersed in the bath 22, a voltage from the power source 26 is applied to the article 20, which drives at least one type of chemically active corrosion inhibitor from the bath 22 into pores of an anodized layer 32 of the article 20 (see FIG. 4).

The one or more chemically active corrosion inhibitors used in the method 200 may include one or more types of anodic corrosion inhibitor, one or more types of cathodic corrosion inhibitor, or a combination thereof. Cathodic corrosion inhibitors prevent reduction reactions on or near a surface region of the article 20, while anodic corrosion inhibitors prevent oxidation on or near a surface region of the article 20, as in the case of galvanic corrosion. Some example anodic corrosion inhibitors include, are but not limited to, permanganate ions (e.g., $MnO_4^{1-}$), vanadate ions, tungstate ions, molybdate ions (e.g., $MoO_4^{2-}$), $ZrF_6^{2-}$, $CrF_6^{3-}$, silicate ions, citrate ions, phosphate ions, nitrate ions, each of which are negatively charged anions, or a combination thereof. Some examples of cathodic corrosion inhibitors include, but not limited to, rare earth cations (such as cerium ions ($Ce^{3+}$), praseodymium ions ($Pr^{3+}$), dysprosium ions ($Dy^{3+}$), lanthanum ions ($La^{+3}$), zinc ions ($Zn^{+2}$), magnesium ions ($Mg^{+2}$), calcium ions ($Ca^{+2}$), each of which are positively charged cations, or a combination thereof. Various complexing agents may also be included to adjust the concentration of inhibitor ions for increased efficacy. Complexing agents and/or organic inhibitors include but not limited to at least one of ethylenediaminetetraacetic acid (EDTA), nitrilotriacetic acid (NTA), aminomethylphosphonic acid, oxalic acid, formic acid, acetic acid, tartaric acid, nicotinic acid, citric acid, or malonic acid or combinations thereof.

FIG. 4 schematically illustrates an example anodized layer 32 that has been sealed using the method 200 of FIG. 2. As shown in FIG. 4, the article 20 includes a core 21 and includes the anodized layer 32 on its exterior. The anodized layer 32 includes an outward-facing region 34A (i.e., having a free exposed surface) and an inward-facing region 34B under the outward-facing region 34A. Chemically active corrosion inhibitors 36 have infiltrated pores of the anodized layer 32. As shown in FIG. 4, a greater concentration of the chemically active corrosion inhibitors 36 are present in the inward-facing region 34B than are present in the outward-facing region 34A. As illustrated in FIG. 4 the method 200 may be used to seal the entire depth or substantially the entire depth of the anodized layer 32. A depth of the sealing is at least 50% of the depth D of the anodized layer in some examples. In a further example, a depth of the sealing is at least 90% of the depth D of the anodized layer. In some such examples, the depth D of the anodized layer 32 is approximately 1-20 μm thick. In a further example, the depth D of the anodized layer is approximately 2-7 μm thick. With the soaking-only technique, infiltration to such depths may not be thorough or, at the least, may take long times.

Figure 5:
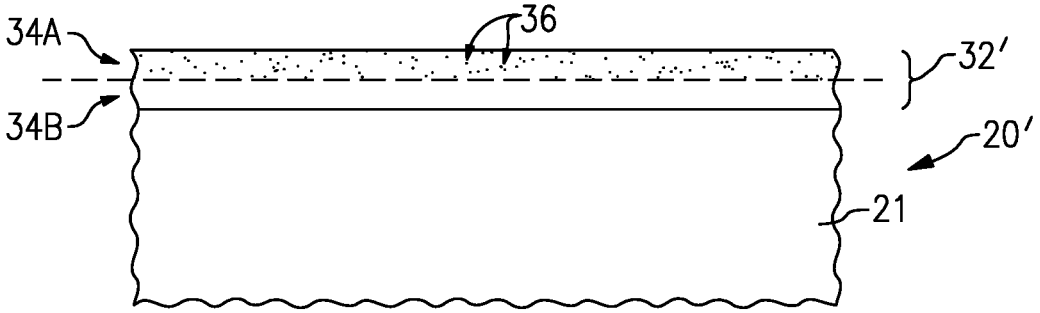
FIG. 5 schematically illustrates an example anodized layer sealed according to a different, soaking-only method.

FIG. 5, in contrast, schematically illustrates an example anodized layer 32' sealed according to the soaking-only method described above in which article 20' is soaked in a bath without application of a voltage. As shown in FIG. 5, a greater concentration of the chemically active corrosion inhibitors 36 are instead present in the outward-facing region 34A, or even accumulate on the top surface of 34A. Additionally, a lesser quantity of the corrosion inhibitors are present overall within the anodized layer 32'.

As discussed above, the one or more chemically active corrosion inhibitors used in the method 200 may include one or more types of anions (negatively charged ions), one or more types of cations (positively charged ions), complexing agents or organic inhibitors, or a combination thereof. In one example, the at least one chemically active corrosion inhibitor includes anions, and the voltage applied during step 204 is a positive voltage on the anodized article 20. In another example, the chemically active corrosion inhibitor includes cations, and the voltage applied in step 204 is a negative voltage on the article 20.

In a further example, the bath 22 includes both anions and cations, and the application of a voltage to the anodized metal article 20 in step 204 includes alternating between application of a positive voltage to drive the anions into the anodized layer 32, and application of a negative voltage to drive the cations into the exterior anodized layer 32 during the immersing of step 202. In such an example, a complexing agent such as a citrate (e.g., cerium citrate), may be used to prevent the anions and cations from precipitating out within the bath 22.

The positive and/or negative voltages are biased direct current (DC) voltages in some examples. For example, a square wave type wave form could be used, which alternates between positive and negative DC voltages. In another example, the positive and negative voltages are part of an alternating current (AC) wave form. In another example, pulse rectification of an AC waveform is used to provide the voltage of step 204. In some examples, the particular pulse parameters are optimized to drive certain corrosion inhibitors to greater depths than others, in order to develop an ordered layer of inhibitors. A type of corrosion inhibitor that promotes adhesion could be the last one deposited, for example.

In one example, a duration of the voltage application of step 204 is approximately 2 to 5 minutes, which is considerably shorter than the soaking-only process described above (which may take approximately 15 to 30 minutes, for example). In the same or another example, a voltage used during step 204 is between approximately 3 volts and 60 volts. In a further example, the voltage use in step 204 is between approximately 10 volts and 15 volts. In some such examples, the bath is at ambient temperature and is not temperature-controlled.

In one example, the method 200 is performed for a first bath 22 containing a first type of chemically active corrosion inhibitor, and is separately performed for a different, second bath 22 that contains a second type of chemically active corrosion inhibitor, such that both types of chemically active corrosion inhibitors are driven into the exterior anodized layer (e.g., such that some pores include both types of chemically active corrosion inhibitors). In one example, one of the first and second type of chemically active corrosion inhibitors are anions and the other of the first and second type of chemically active corrosion inhibitors are cations. In other examples, both types of chemically active corrosion inhibitors are anions or both types of the chemically active corrosion inhibitors are cations. In some examples, a duration of the voltage application of step 204 in each of the subsequent baths is approximately the same and uses approximately the same voltage.

In one example, the chemically active corrosion inhibitor 36 is a nanoparticle pigment, and the bath 22 is a colloidal solution into which the nanoparticle pigment is suspended. In one example, the nanoparticles have a maximum dimension of approximately 1-100 nanometers, but more typically may be 1-10 nanometers. The nanoparticle pigment may include at least one of $Ce_2(MoO_4)_3$, $ZnMoO_4$, $CaMoO_4$, cerium citrate, $MgSiO_3$, $ZnSiO_3$, $CaSiO_3$, $Cr(OH)_3$, $ZrO_2$, $TiO_2$, $NbO_x$, $ZnO_2$, $CoO_x$, phosphates, silicates, nitrates, aggregates of colloidal nanoparticles formed from ions of $PO_4^{3-}$, $SiO_3^{2-}$, $B_2O_4^{2-}$, $Ce^{3+}$, $Y^{3+}$, $La^{3+}$, $Pr^{3+}/Pr^{2+}$, $VO_4^{3-}$, $MoO_4^{2-}$, or $WO_4^{2-}$, or a combination thereof.

In such examples, the pigment and its dispersion medium may be brought into a colloidal state through grinding in a colloidal mill, grinding in a ball mill, or through use of an ultrasonic disintegrator. If the pigment used is $ZrO_2$, for example, a colloidal solution in which the pigment is suspended could be cerium ($Ce^{3+}$)-doped $SiO_2$_$ZrO_2$, which may be synthesized in two parts and then mixed together to obtain the nano-composite Sol. In a first step, $SiO_2$_$ZrO_2$ sol is prepared by a hydrolysis process, and then the Sol is appropriately diluted using 2-butoxy-ethanol and cerium nitrate so that a final concentration of $Ce^{3+}$in the sol is about 0.005~0.01 moles. Of course, it is understood that this is only an example.

In some examples, a chemically active corrosion inhibitor used in step 204 is a trivalent chromate process (TCP) solution which functions mainly by building barriers through chemical precipitation, and incorporating corrosion inhibitive species in the barrier layer during the process. Instead of only soaking, voltage is applied during the step 204.

Although example embodiments have been disclosed, a worker of ordinary skill in this art would recognize that certain modifications would come within the scope of the claims. For that reason, the following claims should be studied to determine their true scope and content.

What is claimed is:

1. A method of coating a metal article, comprising:

exposing a metal article having an exterior anodized layer to a plurality of chemically active corrosion inhibitors through immersion in at least one bath; and applying a voltage to the article during the immersion using pulse rectification of an alternating current (AC) waveform, the voltage driving the plurality of chemically active corrosion inhibitors from the at least one bath into the exterior anodized layer;

the voltage driving a first one of the plurality of chemically active corrosion inhibitors to a greater depth into the metal article than a second one of the plurality of chemically active corrosion inhibitors; and wherein the plurality of chemically active corrosion inhibitors are different from each other and are selected from the group consisting of permanganate ions, vanadate ions, tungstate ions, $ZrF_6^{2-}$, $CrF_6^{3-}$, citrate ions, $Ce_2(MoO_4)_3$, $ZnMoO_4$, $CaMoO_4$, cerium citrate, $MgSiO_3$, $ZnSiO_3$, $CaSiO_3$, $Cr(OH)_3$, $ZrO_2$, $NbO_x$, $ZnO_2$, $CoO_x$, $PO_4^{3-}$, $SiO_3^{2-}$, $B_2O_4^{2-}$, $Ce^{3+}$, $Y^{3+}$, $La^{3+}$, $Pr^{3+}/Pr^{2+}$, $VO_4^{3-}$, and $WO_4^{2-}$.

2. The method of claim 1, wherein after the exposing and applying steps are complete, a concentration of the chemically active corrosion inhibitor is greater in an inward-facing region of the anodized layer than in an outward-facing region of the anodized layer.

3. The method of claim 1, wherein the plurality of chemically active corrosion inhibitors comprise anions, and the voltage is a positive bias on the article.

4. The method of claim 1, wherein the plurality of chemically active corrosion inhibitors comprise cations, and the voltage is a negative bias on the article.

5. The method of claim 1, wherein the plurality of chemically active corrosion inhibitors comprise both anions and cations in a single bath, and said applying a voltage to the article comprises alternating between application of a positive voltage to drive the anions into the exterior anodized layer and a negative voltage to drive the cations into the exterior anodized layer during the immersion.

6. The method of claim 5, wherein the positive voltage and negative voltage are part of the alternating current (AC) waveform.

7. The method of claim 1, wherein a duration of the applying step is approximately 2-5 minutes, and the voltage is between approximately 3 volts 60 volts.

8. The method of claim 1, wherein the voltage is between approximately 10 volts-15 volts.

9. The method of claim 1, wherein said exposing and applying are performed for a first bath containing the first one of the plurality of chemically active corrosion inhibitors using a first voltage, and are separately performed for a second bath containing the second one of the plurality of chemically active corrosion inhibitors using a second voltage, such that the first one and the second one of the plurality of chemically active corrosion inhibitors are driven into the exterior anodized layer.

10. The method of claim 9, wherein a duration of the applying step in each bath is approximately the same, and the voltages used during each applying step are approximately the same.

11. The method of claim 1, wherein the first one or the second one of the plurality of chemically active corrosion inhibitors comprises a nanoparticle pigment, and the at least one bath comprises a colloidal solution in which the nanoparticle pigment is suspended.

12. The method of claim 1, wherein at least one of the plurality of chemically active corrosion inhibitors is selected from the group consisting of $Ce_2(MoO_4)_3$, $ZnMoO_4$, $CaMoO_4$, $CaSiO_3$ and $Cr(OH)_3$.

13. The method of claim 1, wherein at least one of the plurality of chemically active corrosion inhibitors is selected from the group consisting of $MgSiO_3$, $ZnSiO_3$, $CaSiO_3$, and $SiO_3^{2}$.

14. The method of claim 1, wherein:

one of the first and second one of the plurality of chemically active corrosion inhibitors is selected from the group consisting of $Ce_2(MoO_4)_3$, $ZnMoO_4$, $CaMoO_4$, $CaSiO_3$ and $Cr(OH)_3$; and the other of the first and second one of the plurality of chemically active corrosion inhibitors is selected from the group consisting of $MgSiO_3$, $ZnSiO_3$, $CaSiO_3$, and $SiO_3^{2-}$.

15. The method of claim 1, wherein at least one of the plurality of chemically active corrosion inhibitors is selected from the group consisting of $B_2O_4^{2-}$, $La^{3+}$, $Pr^{3+}/Pr^{2+}$, and $VO_4^{3-}$.

16. The method of claim 1, wherein:

one of the first and second one of the plurality of chemically active corrosion inhibitors is selected from the group consisting of $Ce_2(MoO_4)_3$, $ZnMoO_4$, $CaMoO_4$, $CaSiO_3$ and $Cr(OH)_3$; and the other of the first and second one of the plurality of chemically active corrosion inhibitors is selected from the group consisting of $B_2O_4^{2-}$, $La^{3+}$, $Pr^{3+}/Pr^{2+}$, and $VO_4^{3-}$.

17. The method of claim 1, wherein:

one of the first and second one of the plurality of chemically active corrosion inhibitors is selected from the group consisting of $MgSiO_3$, $ZnSiO_3$, $CaSiO_3$, and $SiO_3^{2-}$; and the other of the first and second one of the plurality of chemically active corrosion inhibitors is selected from the group consisting of $B_2O_4^{2-}$, $La^{3+}$, $Pr^{3+}/Pr^{2+}$, and $VO_4^{3-}$.

* * * * *